United States Patent [19]

Kubick

[11] Patent Number: 4,486,913

[45] Date of Patent: Dec. 11, 1984

[54] FLOOR BRUSH CONSTRUCTION

[75] Inventor: Matthew D. Kubick, Poland, N.Y.

[73] Assignee: Perfex Corporation, Poland, N.Y.

[21] Appl. No.: 423,998

[22] Filed: Sep. 27, 1982

[51] Int. Cl.[3] ..... A46B 15/00

[52] U.S. Cl. ..... 15/159 R; 15/146; 15/176

[58] Field of Search ..... 15/159 R, 171, 176, 15/145, 146

[56] References Cited

U.S. PATENT DOCUMENTS

| | | | |
|---|---|---|---|
| 110,325 | 12/1870 | Achew | 15/145 |
| 615,726 | 12/1898 | Lytle | 15/145 |
| 624,708 | 5/1899 | Triest | 15/145 |
| 789,021 | 5/1905 | Hartmann | 15/145 X |
| 902,673 | 11/1908 | Moench | 15/145 |
| 1,179,057 | 4/1916 | Warner | 15/145 X |
| 1,253,904 | 1/1918 | Stokes | 15/145 X |
| 1,450,438 | 4/1923 | Hadsell | 15/146 |
| 1,467,115 | 9/1923 | Rauhoff | 15/145 |
| 1,621,273 | 3/1927 | Read | 15/143 R |
| 3,052,907 | 9/1962 | Kubick | 15/146 |
| 3,076,217 | 2/1963 | Scholl | 15/171 X |
| 3,218,661 | 11/1965 | Fielder, Jr. | 15/145 |
| 3,218,662 | 11/1965 | Fielder, Jr. | 15/145 |
| 3,256,048 | 6/1966 | Rea | 15/146 X |
| 3,629,894 | 12/1971 | Stefany | 15/146 |
| 3,707,739 | 1/1973 | Hermann, Jr. | 15/176 |
| 4,384,383 | 5/1983 | Bryant | 15/159 R |
| 4,392,269 | 7/1983 | Nishiyama et al. | 15/145 |

FOREIGN PATENT DOCUMENTS

| | | | |
|---|---|---|---|
| 146134 | 4/1952 | Australia . | |
| 148398 | 9/1936 | Fed. Rep. of Germany . | |
| 668740 | 11/1938 | Fed. Rep. of Germany . | |
| 25155 | 12/1951 | Finland . | |
| 1106155 | 12/1955 | France . | |
| 1162562 | 9/1958 | France | 15/144 B |
| 1600462 | 9/1970 | France . | |
| 806145 | 12/1958 | United Kingdom . | |

*Primary Examiner*—Philip R. Coe
*Assistant Examiner*—Frankie L. Stinson
*Attorney, Agent, or Firm*—Bruns & Wall

[57] ABSTRACT

A floor brush comprising an elongated handle and a brush assembly connected to one end of the handle, the brush assembly consisting of a unitary brush block in which the brush fibers are set. The brush block is formed with an outwardly extending socket projection that has a relatively long tapered passage the inner end of which communicates with a shorter threaded passage of uniform diameter. An end of the handle is received in the socket projection and has a tapered portion conforming to the tapered socket passage and a threaded portion that mates with the threaded socket passage. When the threaded portions of the handle and socket projection are engaged, they operate to draw the conforming tapered portions thereof into close engagement with one another whereby the stresses in this area of the floor brush are uniformly distributed over a relatively large area. The brush block socket projection is dimensioned with respect to the handle so that it extends upwardly on the handle to a point where the handle is at its maximum diameter.

2 Claims, 4 Drawing Figures

FLOOR BRUSH CONSTRUCTION

BACKGROUND OF THE INVENTION

This invention relates generally to cleaning equipment, and has particular reference to a novel construction for a floor brush.

In conventional floor brush constructions, the elongated handle and brush are separable so that either can be replaced in the event of breakage or wear. Typically, the handle and brush block are releasably secured together by a threaded connection with the threaded end of the handle being received in a threaded bore in the brush block. The threaded end of the handle generally has a smaller diameter than the remainder of the handle and this results in a weakened handle area just outside the brush block bore as will be explained more fully in the description to follow. In using a floor brush, the ends of the brush block are frequently knocked against walls, posts and other objects and this creates moments of force that are carried back to the weakened part of the handle making the handle particularly vulnerable to breakage at that point.

SUMMARY OF THE INVENTION

In the floor brush of the present invention, means on the handle and brush block coact to provide a novel connecting structure that uniformly distributes stresses over a relatively large area. With this connecting structure, there is no part of the handle that is weaker than any other part and a strong and durable construction is achieved.

The floor brush comprises an elongated handle and a brush assembly connected to one end of the handle, the brush assembly in its preferred form consisting of a unitary polymer brush block in which the brush fibers or bristles are set. The brush block is formed with an outwardly extending socket projection that has a relatively long tapered passage extending inwardly from its outer end. The inner end of this passage communicates with a shorter threaded passage of uniform diameter.

An end of the handle is received in the socket projection and has a tapered portion conforming to the tapered socket passage. The tapered portion of the handle terminates in a threaded portion that mates with the threaded socket passage and when the threaded portions of the handle and socket projection are engaged, they operate to draw the conforming tapered portions thereof into close engagement with one another whereby the stresses in this area of the floor brush are distributed over a relatively large area. The brush block socket projection is dimensioned with respect to the handle so that it extends upwardly on the handle to a point where the handle is at its maximum diameter.

DESCRIPTION OF THE PREFERRED EMBODIMENT

Figures 1, 2, 3, 4:
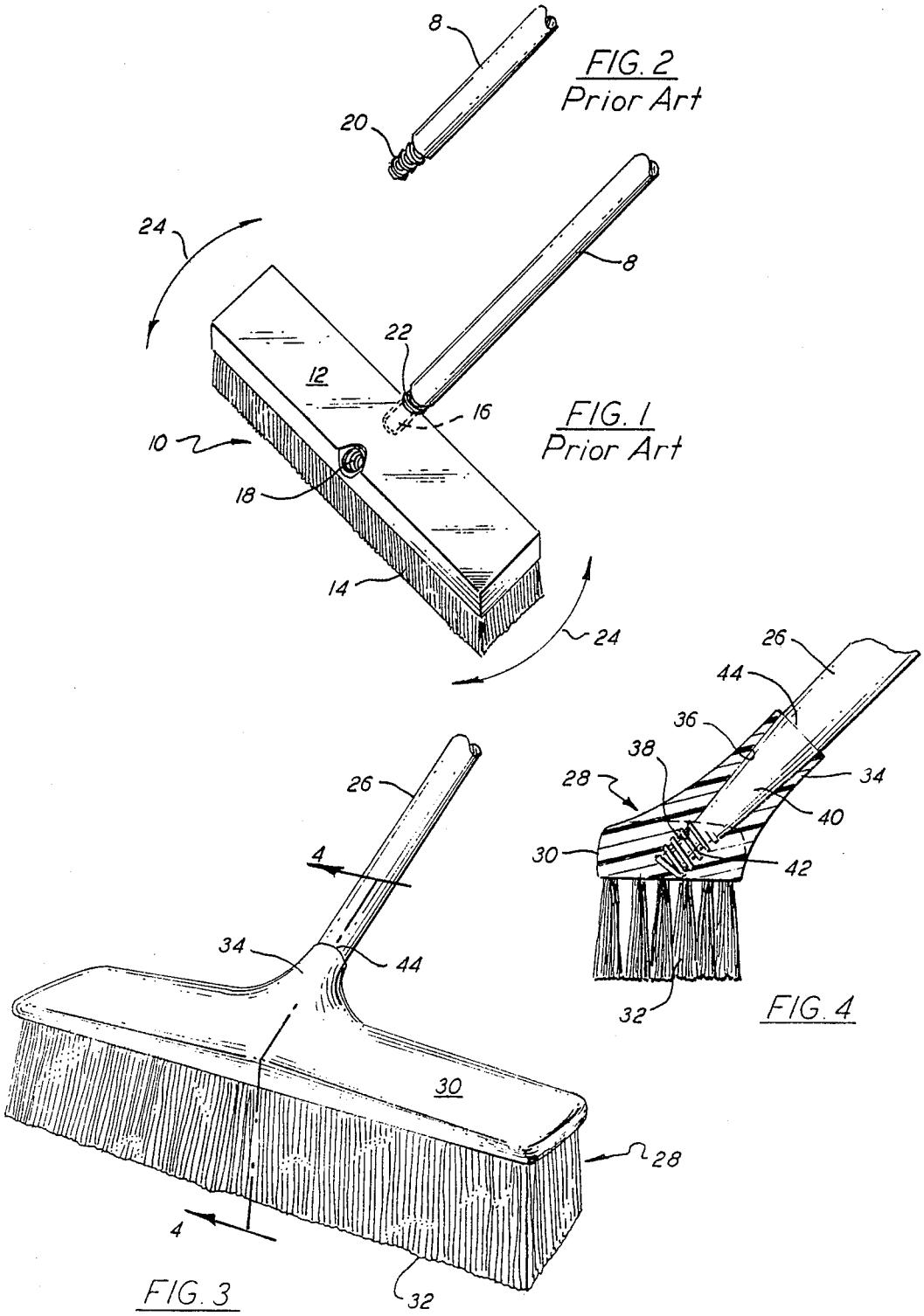
FIG. 2 Prior Art
FIG. 1 Prior Art
FIG. 1 is a fragmentary top perspective view of a prior art floor brush.
FIG. 2 is a fragmentary perspective view of the handle of the brush of FIG. 1.
FIG. 3 is a fragmentary top perspective view of a floor brush embodying the present invention.
FIG. 4 is a vertical sectional view through the brush of the invention taken on line 4—4 of FIG. 3.

Having reference now to the drawings, FIGS. 1 and 2 illustrate a well-known floor brush construction comprising a handle 8 and brush assembly 10, the latter having a brush block 12 and fibers or bristles 14. The handle 8 is threaded into either one of two threaded bores 16 or 18, and the threaded portion 20 of the handle generally has a slightly reduced diameter as indicated in FIG. 2. This results, when the handle and brush block are connected together, in a weakened area shown at 22 on the handle.

The weakened area is at the root of the handle thread just above the upper end of the threaded bore in the brush block 12. With this construction, when the ends of the brush block strike walls, posts or other objects, moments of force as indicated by arrows 24 are created and these cause stresses to be concentrated in the weakened area 22 of the handle. The moments of force increase as the width of the brush increases and make the brush handle particularly vulnerable to breakage at the weakened area 22.

Referring now to FIGS. 3 and 4, the floor brush of the invention is essentially comprised of a handle 26 and a brush assembly 28 connected to one end of the handle. The brush assembly includes a unitary brush block 30 and a plurality of groups of fibers or bristles 32 that are set in the brush block. The brush block 30 is preferably formed of a moldable polymer such as polypropylene or polyethylene while the handle 26 can be made of hardwood, metal, polymer or "Fiberglas".

The fibers 32 project outwardly from one side of the brush block 30 as shown in FIGS. 3 and 4, and on the opposite side of the block there is an integral socket projection 34. The socket projection is located midway between the ends of the brush block and extends upwardly and outwardly therefrom at an oblique angle to the main plane of the block. One end of the handle 26 is received in the socket projection 34 and in accord with the invention the socket is formed with a relatively long tapered passage 36 that communicates at its smaller, inner end with a shorter threaded passage 38 of uniform diameter.

As best shown in FIG. 4, the handle 26 has at its lower end an elongated tapered portion 40 that closely conforms to the tapered socket passage 36. The tapered handle portion terminates in a shorter threaded portion 42 that mates with the threaded socket passage 38. With this construction, when the handle is inserted in the socket passage and turned to engage the handle and socket threaded portions the latter operate to draw the respective tapered portions of the handle and socket projection into intimate contact with one another. This means that stresses transmitted to this area of the floor brush will be uniformly distributed over a relatively large area rather than being concentrated in a small area as in prior art constructions. The construction described also achieves a locking effect in that once the handle is drawn all the way into the socket projection more force is needed to unthread it than was needed to thread the parts together initially.

In addition to distributing stresses over a relatively large area of the handle and brush block connecting structure, it can be seen from FIG. 4 that the socket projection 34 extends upwardly on the handle to a point 44 where the handle is at its largest diameter. This arrangement precludes the possibility of a specific weakened area anywhere along the handle as will be understood.

From the foregoing description it will be apparent that the invention provides a novel and very advantageous construction for a floor brush or the like. As will be understood by those familiar with the art, the invention may be embodied in other specific forms without departing from the spirit or essential characteristics thereof.

I claim:

1. A floor brush comprising an elongated handle and a brush assembly connected to one end of the handle, the brush assembly including a unitary brush block of moldable material and fibers set in the block and projecting outwardly from one side thereof, the brush block having an integral socket projection in which said one end of the handle is received, the socket projection extending outwardly from the brush block at an oblique angle thereto on the side of the block opposite the fibers, the socket projection having a relatively long continuously tapered passage extending from its outer end inwardly, the smaller, inner end of the passage communicating with a shorter threaded passage of uniform diameter, the end of the handle that is received in the socket projection having a tapered portion conforming to the tapered socket passage, the tapered handle portion terminating at its smaller end in a shorter threaded portion that mates with the threaded socket passage, the engagement of the threaded portions of the handle and socket projection operating to draw the tapered portions thereof into intimate contact with one another whereby the stresses in this area of the floor brush are uniformly distributed over a relatively large area, the socket projection being dimensioned with respect to the handle so that it extends upwardly on the handle to a point where the handle is at its maximum diameter.

2. A floor brush as defined in claim 1 wherein the brush block is formed of a moldable polymer.

* * * * *